US006401763B2

(12) United States Patent
Shimono

(10) Patent No.: US 6,401,763 B2
(45) Date of Patent: Jun. 11, 2002

(54) WOVEN SLIDE FASTENER STRINGER

(75) Inventor: Muchiji Shimono, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/790,643

(22) Filed: Feb. 23, 2001

(30) Foreign Application Priority Data

Mar. 2, 2000 (JP) ..... 2000-056951
Sep. 14, 2000 (JP) ..... 2000-280512

(51) Int. Cl.[7] ..... A44B 19/40; A44B 19/54; D03D 1/00

(52) U.S. Cl. ..... 139/384 B; 24/392

(58) Field of Search ..... 139/384 B; 24/392

(56) References Cited

U.S. PATENT DOCUMENTS 4,231,139 A * 11/1980 Tsubata ..... 139/384 B
4,623,004 A * 11/1986 Matshushima et al. . 139/384 B
4,799,515 A * 1/1989 Ohfusa ..... 139/384 B
5,472,019 A * 12/1995 Shimono ..... 139/384 B
6,105,625 A * 8/2000 Shimono et al. ..... 139/384 B

* cited by examiner

*Primary Examiner*—Andy Falik
(74) *Attorney, Agent, or Firm*—Finnegan, Henderson, Farabow, Garrett & Dunner, L.L.P.

(57) ABSTRACT

A woven slide fastener stringer comprising a fastener tape comprising a plurality of foundation weft yarns, a plurality of warp yarns, and a plurality of coupling element portions, which are continuously formed of synthetic resin monofilament, woven successively along a side edge of the fastener tape with a plurality of element fixing warp yarns arranged in parallel at the same time when the fastener tape woven. The coupling element portions have such a weaving structure such that a pair of upper and lower leg portions are tightened by the fixing warp yarns and the tightening force on a coupling-head side of the upper and lower leg portions is smaller than the tightening force to a connecting-portion side thereof.

10 Claims, 11 Drawing Sheets

WOVEN SLIDE FASTENER STRINGER

BACKGROUND OF THE INVENTION

1. Field of the Invention

The present invention relates to a slide fastener stringer in which a continuous element row formed of synthetic resin monofilament is woven and fixed on a fastener tape along a side edge of the tape at the same time when the fastener tape is woven.

2. Description of the Related Art

A well known woven slide fastener stringer of this kind is disclosed in, for example, United Kingdom Patent No. 1221114 or Japanese Patent Application Laid-open Publication No. 2-17162. According to the Publication, an element row, which is comprised of plural coil-like coupling element portions arranged in parallel and obtained by forming synthetic resin monofilament, is fixed along a side edge of a fastener tape. The element row is woven and fixed with fixing warp yarns and foundation weft yarns at the same time when the fastener tape is woven.

Each of the coupling element portions is comprised of a coupling head protruded outward from the side edge of the fastener tape, a pair of upper and lower leg portions extended in parallel inward of the tape and a connecting portion for connecting the upper and lower leg portions of adjacent coupling element portions. In the slide fastener stringer disclosed in the aforementioned publication, the foundation weft yarns, each of which is comprised of double yarns, are disposed below the lower leg portion of each coupling element portion. That is, one coupling element portion is woven together with the weft yarn each time when the weft yarn is weft inserted.

In the woven slide fastener stringer disclosed in said United Kingdom Patent, transparent monofilaments are used for warp yarns and weft yarns composing a foundation structure of the fastener tape. Similarly, transparent monofilaments are used for all the warp yarns for fixing the coupling element rows. This woven slide fastener stringer is characterized in that the foundation structure is formed to be coarse and that intersecting portions of the warp yarns and the weft yarns of the foundation structure are made to fused and fixed to each other.

The woven slide fastener stringer disclosed in said Japanese Laid-open Publication No. 2-17162 on the other hand is characterized in its weaving structure. Specifically, as shown in FIG. 11 attached to this specification, each coupling element portion E is supported by 12 fixing warp yarns $W_1$ to $W_{12}$ in total. On the side of connecting portions of the coupling element portions E, eight warp yarns $W_5$ to $W_{12}$ are guided in successively in the same repeating patterns of high-high-low-middle in a plan view of the fastener tape. Further, on the side of the coupling heads, four warp yarns $W_1$ to $W_4$ are guided in successively in the repeating patterns of high-middle-low-middle. Here, "high" means that the warp yarn supports the upper and lower leg portions L from above, "middle" means that the warp yarn is disposed between the lower leg portion of the upper and lower leg portions L and the foundation weft yarn w, and "low" means that the foundation weft yarn w supports the upper/lower leg portions from below. Meanwhile, in FIG. 11, a representation of the coupling heads of the coupling element portions is omitted to a necessary extent to facilitate understanding graphically.

With such a weaving structure, not only a pitch between adjacent coupling element portions becomes stable, but also density of warp yarns composing a warp yarn pocket can be remarkably intensified without giving any high tension. Thus, the pitches between the coupling element portions are stabilized so that excellent flexibility of the fastener tape can be secured. Consequently, this slide fastener can be sewed to a fabric material, to which the slide fastener is to be attached, such as clothes and bag at high speeds.

The woven slide fastener stringer disclosed in the above-mentioned United Kingdom Patent has a coarse fastener tape, which is composed of transparent monofilaments. Therefore, even when a slide fastener with such a slide fastener stringer is attached to colored clothes for example, it is still possible to perceive the colors of the clothes.

Although, the warp yarns for fixing the coupling element portions are also transparent monofilaments, the slide fastener stringer only has such a weaving structure that four fixing warp yarns run over an upper portion of the coupling element portion and then run below an adjacent coupling element portion, and the respective adjacent fixing warp yarns are woven alternately so as to intersect each other. Therefore, a tightening (fixing) strength of the coupling element portions with respect to a side edge portion of the tape is merely uniform in a region from the connection portions to the coupling heads thereof.

In the slide fastener stringer disclosed in the above-mentioned Japanese Laid-Open Publication, particularly the four warp yarns disposed on the side of the coupling heads, among the fixing warp yarns for fixing the coupling element portions arranged in parallel, run in the same repeating patterns of high-middle-low-middle with respect to the coupling element portions and the weft yarns as described above. The running patterns of the respective adjacent warp yarns are shifted by one pitch of the element portion (weft yarn).

On the other hand, among the fixing warp yarns, eight warp yarns disposed on the side of the connecting portions of the coupling element portions run in the same repeating patterns of high-high-low-middle, which are shifted by one pitch of the element portion (weft yarn).

Both kinds of the repeating patterns of the fixing warp yarns on the sides of the coupling heads and the connecting portions of the paired upper and lower leg portions have no large difference in terms of a weaving structure. Therefore, both the coupling head sides and the connecting portion sides of the paired upper and lower leg portions are fixed with substantially the same strength. Moreover, there is no reference to a variation in said tightening strength of the warp fixing yarns at the coupling head side and the connecting portion side in the above-mentioned Publication. Therefore, the fixing strength of the fixing warp yarns does not vary in a longitudinal direction of the upper and lower leg portions.

Meanwhile, major functions of the coupling element portions in a slide fastener are to guide sliding of a slider during an opening or a closing operation of the fastener by means of the slider, to facilitate introducing of coupling heads smoothly into between adjacent element head portions of opposing coupling element portions when closing the fastener, and to keep a firm coupling between adjacent element head portions when the coupling element portions engage with each other so as not to be disengaged from each other easily.

However, according to a fixing structure for the coupling element portions in the slide fastener stringer as disclosed in the above-mentioned United Kingdom Patent or Japanese Laid-Open Publication, the tightening (fixing) strength of the respective fixing warp yarns for fixing the upper and lower leg portions of the coupling element portions does not vary in the longitudinal direction of the upper and lower leg portions as mentioned above. The fixing strength of the respective coupling element portions to the fastener tape is, however, required to be as large as possible in order to secure a smooth movement of a slider. At the same time, the coupling heads, which are free ends of the coupling element portions, are required to have gaps therebetween sufficient for introducing mating coupling heads and to secure strong couplings between the coupling heads after being coupled with each other.

Furthermore, according to the fixing structure for the element portions in the slide fastener stringer as disclosed in the above-described Japanese Laid-Open Publication, the fixing strength for fixing the paired upper and lower leg portions of each coupling element portion by each fixing warp yarn does not differ in the longitudinal direction of the upper and lower leg portion as described above. Meantime, the fixing strength of each coupling element portion to the fastener tape must be as large as possible in order to ensure a smooth operation of the slider. On the other hand, on the side of the coupling heads, which are free ends of coupling element portions, it is necessary to provide a sufficient gap for introducing a mating coupling head into two adjacent coupling heads to keep a firm coupling between the respective heads after the coupling is attained.

In the slide fastener stringer disclosed in the above-mentioned United Kingdom Patent and Japanese Laid-Open Publication, however, substantially equal tightening forces are applied in the longitudinal direction of the upper and lower leg portions of the coupling element portions, because the fixing structure comprised of such plural fixing warp yarns is substantially the same in the range from the connecting portions to the coupling heads of the coupling element portions. If the weaving tension of the fixing warp yarns is increased more than its normal level in order to increase the tightening force to the fastener tape, not only the tightening force to the fastener tape is increased, but also the tightening force on the side of the coupling heads is increased. As a result, it becomes difficult to couple with a mating slide fastener stringer.

If the weaving tension for each fixing warp yarn is decreased less than its normal level to secure a firm coupling, on the other hand, fixing of the coupling element portions with the fixing warp yarns becomes loose, so that the fixing strength to the entire coupling elements declines. Consequently, the upper and lower leg portions become easy to move in a width direction of the tape, so that not only smooth sliding of the slider is disabled, but also such a defect as a slip-out from the coupling may occur.

SUMMARY OF THE INVENTION

According to the present invention, there is provided a woven slide fastener stringer including a fastener tape composed of a plurality of foundation weft yarns and a plurality of warp yarns, and a plurality of coupling element portions, which are continuously formed of synthetic resin monofilament, woven successively along a side edge of the fastener tape with a plurality of element fixing warp yarns arranged in parallel at the same time when the fastener tape is woven, wherein each of the coupling element portions is comprised of a coupling head protruded outward from the side edge of the fastener tape, a pair of upper and lower leg portions extended in parallel inward of the fastener tape from opposite ends of the coupling heads and a connecting portion for connecting each end of the pair of the upper and lower portions with one of a lower leg portion or an upper leg portion of an adjacent coupling element portion. Further, the woven fastener stringer comprises a weaving structure that a tightening force to the pair of the upper and lower leg portions by at least two of the plurality of the element fixing warp yarns arranged in parallel, which are disposed on a side of the coupling heads, is smaller than a tightening force to the pair of the upper and lower leg portions by at least one of the element fixing warp yarns disposed on the side of said connecting portions. The plurality of the element fixing warp yarns are woven into the coupling element portions and foundation weft yarns with said weaving structure.

According to the present invention, a fixing strength on the paired upper and lower leg portions of each coupling element portion to the fastener tape by the fixing warp yarns and a behavior permissible between the coupling heads of the fixed adjacent coupling element portions are made to depend on the weaving structure of the fixing warp yarns. Then, the fixing strength is specified by a relative tightening strength generated based on the weaving structure of the fixing warp yarns with respect to the foundation weft yarn of the fastener tape and the paired upper and lower leg portions of the coupling element portions.

As a result, the fixing of the coupling elements to the fastener tape by the fixing warp yarns is intensified particularly on the side of the connecting portions of the upper and lower leg portion. Thus, the coupling elements are fixed neatly at an equal pitch along the side edge of the fastener tape, so that the opening and closing operation of the fastener by means of a slider can be smoothed. Further, on the side of the coupling heads, a gap between the coupling heads can be expanded or reduced slightly, so that the coupling operation of the respective coupling element portions can be carried out smoothly.

Furthermore, according to the present invention, the difference of the above-described tightening forces is made to depend on structures of the fixing warp yarns. Specifically, it is preferable that said at least one of the plurality of the element fixing warp yarns arranged in parallel, which is disposed on the side of the connecting portions, is composed of a monofilament that is set to have a larger tightening force to the pair of the upper and lower leg portions than a tightening force by any other one of the element fixing warp yarns.

With such a structure, the coupling elements can be more firmly fixed to the fastener tape by the fixing warp yarns, especially at the connecting portion side of the upper and lower leg portions, without any special adjustment of tensions of the respective yarns in a weaving process but only by applying the structures and materials of the yarns. Consequently, the coupling element portions can be fixed along a side edge portion of the fastener tape neatly at an equal pitch, so that the opening and closing operation of the fastener with a slider can be remarkably smoothly carried out, and the respective gaps between the respective adjacent coupling heads can be slightly expanded or reduced, which makes the coupling operation of the respective coupling element portions smooth.

Still further, according to the present invention, the most effective weaving structure of the fixing warp yarns is specified.

That is, according to the present invention, there is provided a woven slide fastener stringer, wherein the at least two element fixing warp yarns disposed on the side of the coupling heads, which have a small tightening force to the paired upper and lower leg portions, intersect two or more of the foundation weft yarns and then run over top faces of adjacent two or more upper leg portions of the upper and lower leg portions at the side of the coupling heads, and repeat the same pattern successively, and the element fixing warp yarns disposed on the side of the connecting portions, which have a large tightening force to the paired upper and lower leg portions, run below one of the foundation weft yarns and then run over a top face of the upper leg portion of the pair of the upper and lower leg portions at the side of the connecting portions, and repeat the same pattern successively.

The weaving structure of the element fixing warp yarns disposed on the side of the connecting portions, which have a large tightening force to the paired upper and lower leg portions, provides the largest tightening force with respect to the upper and the lower leg portions. Therefore, the fixing strength of the coupling element portions to the fastener tape becomes the largest among weaving structures of the coupling elements. On the other hand, according to the weaving structure of the element fixing warp yarns disposed on the side of the coupling heads, which have a smaller tightening force to the paired upper and lower leg portions, a single fixing warp yarn tightens upper portions of two or more pairs of the upper and lower leg portions with respect to the fastener tape. Thus, the two or more upper and lower leg portions tightened in such a manner are allowed to move slightly in a direction of the parallel arrangement of the coupling heads, as compared to the coupling element portions tightened by the element fixing warp yarns disposed on the side of the connecting portions.

Still further, according to the present invention, the patterns of said at least two adjacent element fixing warp yarns disposed on the side of the coupling heads are shifted by one pitch of each of the coupling element portions in a longitudinal direction of the tape. With such a weaving structure, the paired upper and lower leg portions of each of the coupling element portions are tightened by adjacent fixing warp yarns alternately from the right and left. Consequently, not only the slight movement is allowed to a parallel direction of the coupling heads, but also a further stabilized pitch between the coupling heads can be secured.

Still further, according to the present invention, a 1 pick/1 pitch weaving structure is specified. That is, each of the coupling element portions is weft inserted together with the foundation weft yarn, which is weft inserted into each opening. Alternatively, according to the present invention, a two picks/1 pitch weaving structure is specified. Namely, each of the coupling element portions is weft inserted with respect to every other foundation weft yarn which is weft inserted into each opening.

In general, a coarse fastener tape, which has a low weft-yarn density, tends to have a lower fixing strength of fixing warp yarns against coupling element portions, because of its weaving structure. In this case, it is preferable to provide large fineness to the fixing warp yarns on the side of the connecting portions, thereby obtaining a required fixing strength. Therefore, in such a case where a coarse fastener tape is to be obtained, the above-described 1 pick/1 pitch weaving structure is preferable.

Still further, according to the present invention, it is preferable that another foundation warp yarn is disposed between the coupling heads and the element fixing warp yarn disposed at the nearest to the coupling heads, and the foundation warp yarn alternately runs over and below the weft yarns that are weft inserted and arranged adjacent to each other.

Such a weaving structure increases a dimensional stability in the longitudinal direction of the fastener tape along the side edge thereof near the coupling heads. Therefore, coupling between the coupling elements can be maintained securely when the slide fastener is closed.

Still further, according to the present invention, the distribution of the tightening forces on the connecting portion side and the coupling head side of the coupling element portions as described above may be exerted based on the yarn structures of the fixing warp yarns. Specifically, said at least one of the plurality of the element fixing warp yarns disposed on the side of said connecting portions has a larger fineness than any other one of the element fixing warp yarns disposed on the side of said coupling heads. The fineness is to be determined by a dimension and/or a weaving density, but should not be specified uniformly.

Even a monofilament could have a poor flexibility when it has a large fineness, if it is the same material. However, according to the present invention, when monofilaments are woven into a fastener tape in order to fix the coupling element portions which are composed of a monofilament, the respective adjacent fixing monofilaments intersect with each other between the respective adjacent coupling element portions. At this time, the larger the fineness of the monofilament is, the larger the intersecting angle at this time becomes. Therefore, the coupling element portions are restricted from moving in a parallel direction thereof. This can also be applied to a case where multifilaments or ordinary spun yarns are used for the fixing warp yarns to be disposed on the side of the coupling heads.

Still further, the characteristics of the fixing warp yarns disposed on the sides of the connecting portions and the coupling heads of the coupling element portions as described above can be specified in terms of their property. Specifically, according to the present invention, said at least one of the plurality of the element fixing warp yarns disposed on the side of said connecting portions has a lower pull elastic modulus than any other one of the element fixing warp yarns disposed on the side of said coupling heads.

This aspect of the present invention has developed the function in terms of the above-mentioned property by the difference of the pull elastic modulus. Specifically, the yarn with a high pull elastic modulus has a large elastic deformation, so that it can more easily deform by an external force than the yarn with a lower pull elastic modulus. Therefore, when the yarn that is composed of a thick monofilament and a low pull elastic modulus is used of the fixing warp yarns on the side of the connecting portions, the tightening force to the element row in the weaving process becomes larger than the other fixing warp yarns. Further, in a fastener tape as a product, the warp fixing warp yarns on the side of the connecting portions are unlikely to cause any deformation as compared to the other fixing warp yarns, even when an external force is applied. A value of the pull elastic modulus is not to be specified, because it should be relatively determined between the warp yarns on the connecting portion side and those on the coupling head side, depending on an intended use, application field of the fastener tape.

Still further, according to the present invention, the characteristics of the fixing warp yarns as described above is specified in terms of property, namely the rigidity of the fixing warp yarns. Specifically, said at least one of the plurality of the element fixing warp yarns disposed on the side of said connecting portions has a larger rigidity than any other one of the element fixing warp yarns disposed on the side of said coupling heads. The function is the same as described above. Similarly, a value of the rigidity is to be determined relatively determined between the warp yarns on the connecting portion side and those on the coupling head side, depending on an intended use, application field of the fastener tape.

DESCRIPTION OF EMBODIMENTS

Hereinafter, embodiments of the present invention will be described in detail with reference to the accompanying drawings.

Figure 1:
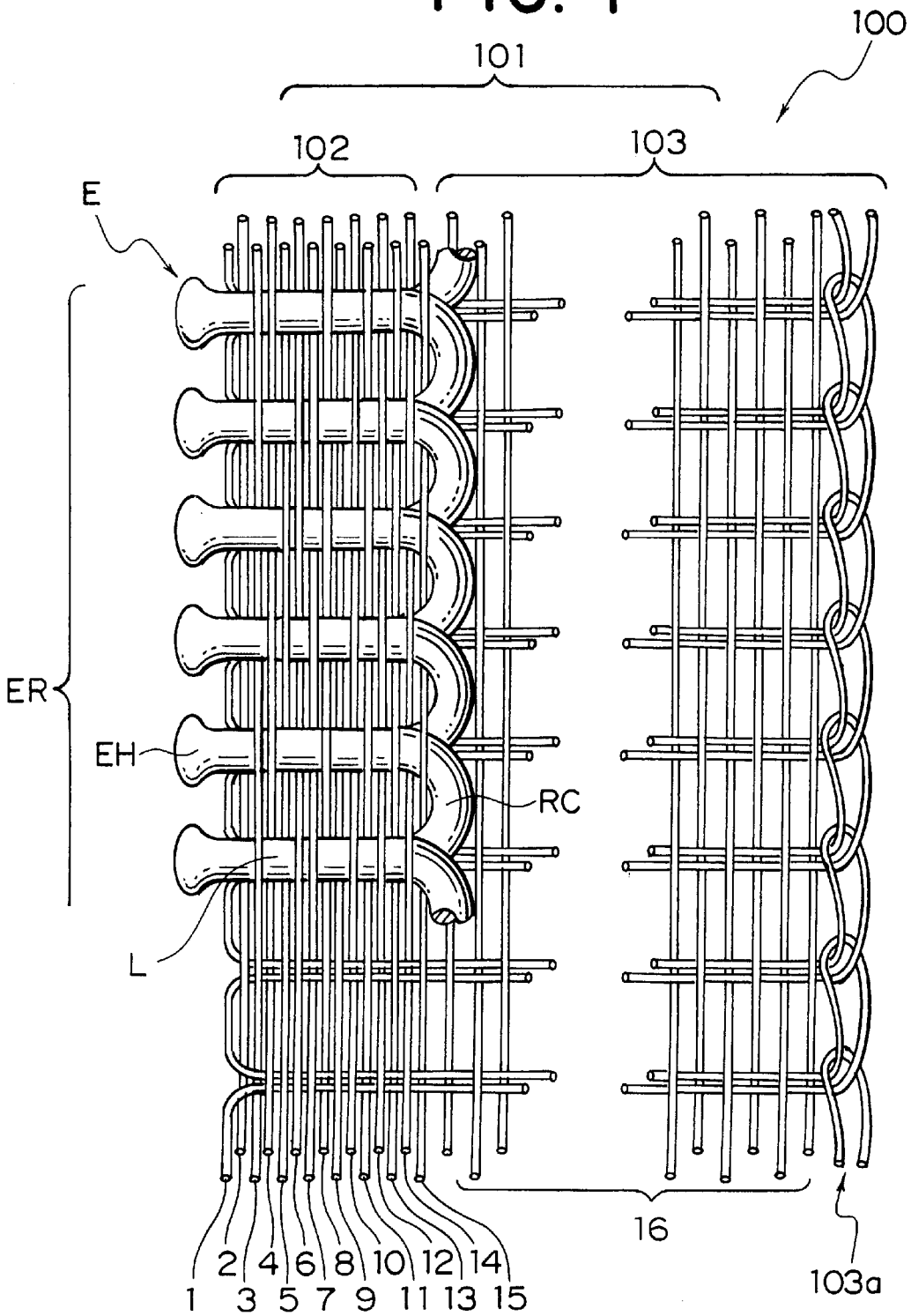
FIG. 1 is a plan view showing part of a slide fastener stringer according to a first embodiment of the present invention, which is partly cut out.
Figure 2:
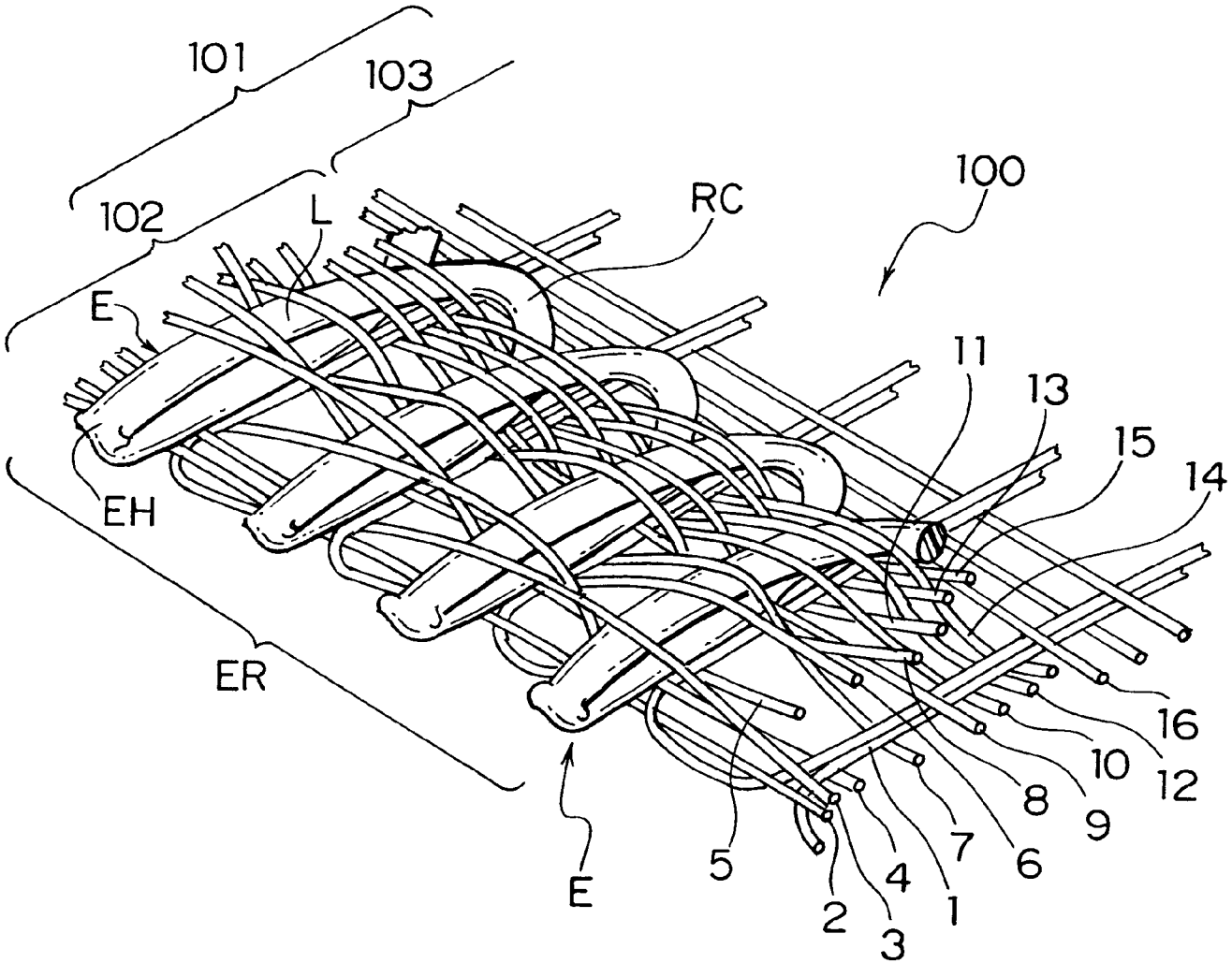
FIG. 2 is a perspective view showing part of a fixing structure of a coupling element row of the slide fastener stringer.

FIGS. 1 and 2 show a slide fastener stringer woven by 1 pick/1 pitch according to a typical, first embodiment of the present invention. FIG. 1 is a plan view showing a coupling element row, which is partly cut out. Here, a representation of a central portion in the width direction of the fastener tape is omitted. FIG. 2 is a partial perspective view of an attaching portion of the coupling element row of the same stringer. For easy understanding, various kinds of weft yarns and warp yarns are shown thinner than actual with respect to the coupling element row and the weaving structure (organization) is shown coarsely. However, in the actual use, yarns having a predetermined thickness are used for the various weft yarns and warp yarns, in consideration of the function of the slide fastener stringer. The actual weaving structure is formed more finely so as to provide a structure that can exert a function as a fastener.

In a woven slide fastener stringer 100 of the present invention, a coupling element row ER is woven into and fixed to a coupling-element-row-fixing region 102 of a fastener tape 101, which is comprised of the coupling-element-row-fixing region 102 and a tape main portion 103. According to the present invention, a foundation weft yarn 1, which is a composing yarn of the fastener tape 101, is comprised of double yarns because it is weft inserted by reciprocation of a carrier bar (not shown) into a shuttle road in a warp yarn opening. The warp yarns are comprised of foundation warp yarns 2, 16, 16, . . . composing a foundation structure of the fastener tape, insertion warp yarn 9 and fixing warp yarns 3 to 8, and 10 to 15 for the coupling element row ER.

Twelve element-row-fixing warp yarns 3 to 8, and 10 to 15 are disposed in the coupling-element-row-fixing region 102 and a plurality of the foundation yarns 2, 16, 16, . . . including the insertion warp yarn 9 are disposed in the tape main portion 103 and the coupling-element-row-fixing region 102. These warp yarns are successively arranged in the order of the numerals from an outside edge of the coupling-element-row-fixing region 102 and supplied onto a weaving machine (not shown).

The coupling element row ER, which is comprised of a plurality of coupling element portions E formed continuously in a coil shape from synthetic resin monofilament, is woven into and fixed to the weaving structure of the coupling-element-row-fixing region 102. Each of the coupling element portion E is comprised of a coupling head EH, which is protruded outward from the coupling-element-row-fixing region 102 of the fastener tape 101, a pair of upper and lower leg portions L extending inward of the fastener tape 101 in parallel to each other from opposite ends of the coupling head EH in a direction perpendicular to the fastener tape 101, and a connecting portion RC for connecting each end portion of the upper and lower leg portion L with one of a lower and an upper leg portions of adjacent coupling element portions E preceding and following in an extending direction of the tape.

The coupling element portion E is introduced and weft inserted by the carrier bar (not shown), which reciprocates in a predetermined length from the coupling-element-row-fixing region 102 to the tape main portion 103, at the same time when the foundation weft yarn 1 is weft inserted as being reciprocated. Therefore, according to this embodiment, each foundation weft yarn 1 exists along lower portions of the paired upper and lower leg portions L of the coupling element portion E.

A knitting needle (not shown) is inserted through a looped turnover end, at an end portion of the foundation weft yarn 1 on the side of the tape main portion 103. This knitting needle picks up a turnover end loop while going out of a preceding end loop, at the time of insertion of the foundation weft yarn 1 at a next position. Consequently, adjacent end loops are joined together successively so that an edge portion 103*a* of the tape main portion 103 can be formed.

According to the present embodiment, four adjacent fixing warp yarns 3 to 6 among the fixing warp yarns 3 to 8, and 10 to 15, which are disposed toward the coupling heads EH of the coupling element portions E, run over two adjacent pairs of upper and lower leg portions L and then, intersects two foundation weft yarns 1 disposed below the pairs of the upper and lower leg portions L of the next position. This pattern is then repeated. The patterns of the respective four fixing yarns 3 to 6 are shifted by one pitch of the coupling element portion E in the longitudinal direction of the tape. Thus, the coupling element portions E are woven into and fixed to the fastener tape 101 successively.

According to this embodiment, in which the four adjacent fixing warp yarns 3 to 6 toward the coupling heads EH intersect the foundation weft yarns 1, the respective fixing yarns 3 to 6 run over top faces of the upper/lower leg portion L of the coupling element portions E and then run below one foundation weft yarn 1 of the next position, and further runs between the foundation weft yarn 1 of a further next position and the paired upper and lower leg portions. This pattern is repeated.

Two fixing warp yarns 7 and 8 next to the four fixing warp yarns 3 to 6, which are arranged toward the connecting portions RC of the upper and lower leg portions L, run over the paired upper and lower leg portions L of a single coupling element portion E and after that, run below the foundation weft yarn 1 located below a coupling element portion E of the next position. This pattern is repeated. The patterns of the fixing warp yarns 7 and 8 are shifted by one pitch of the coupling element portion E. There is one insertion warp yarn 9 disposed next to these two fixing warp yarns 7 and 8. The insertion warp yarn 9 is located in a middle of the foundation weft yarns 1 running in parallel thereto and the coupling element portions E.

Six fixing warp yarns 10 to 15, which are disposed adjacent the insertion warp yarn 9 at an inner side of the tape, run repeatedly in the same patterns as said two fixing warp yarns 7 and 8, which are also shifted by one pitch of the coupling element. A foundation warp yarn 16 in the fastener tape main portion 103, which is disposed inward of the tape from these fixing warp yarns 10 to 15, alternately runs over and below the foundation weft yarns 1 running in parallel to each other. Consequently, a plain weaving structure is formed. Further, according to this embodiment, a foundation warp yarn 2 is disposed near the coupling heads EH such that it runs over and below the foundation weft yarns 1 parallel to each other alternately, on a tape-edge side of the four fixing warp yarns 3 to 6.

According to the above described structure, the woven slide fastener stringer of this embodiment produces two different kinds of tightening forces for the coupling element E. Specifically, when the weaving tensions are made to be equal in all the fixing warp yarns 3 to 8, and 10 to 15, one of the tightening forces is to be applied to the coupling element portions E with the fixing warp yarns 3 to 8 on the side of the coupling head EH, which run over the pairs of upper and lower leg portions L of the two adjacent coupling element portions E, then run below a foundation weft yarn 1 of the next position, further run between one foundation weft yarn 1 and the upper and lower leg portions of a further next position, and repeats the same pattern. The other tightening force is to be applied to the coupling element portions E with the fixing warp yarns 7, 8, and 10 to 15 on the side of the connecting portions RC, which run over the upper and lower leg portions L of one coupling element portion E, then run below the foundation weft yarn 1 running under the coupling element portion E of the next position, and repeat the same pattern. At this time, the former tightening force is smaller than the latter one.

In the weaving structure of the fixing warp yarns, a weaving structure having a large tightening force is applied to the fixing warp yarns 7, 8, and 10 to 15 located near the connecting portions RC of the coupling element portions E. On the other hand, a weaving structure having a small tightening force is applied to the fixing warp yarns 3 to 6 near the coupling heads EH of the coupling element portions E. Consequently, the tightening force of the fixing warp yarns 7, 8, and 10 to 15 near the connecting portions RC of the paired upper and lower leg portions L is made larger than the tightening force of the fixing warp yarns 3 to 6 near the coupling heads EH.

Figure 3:
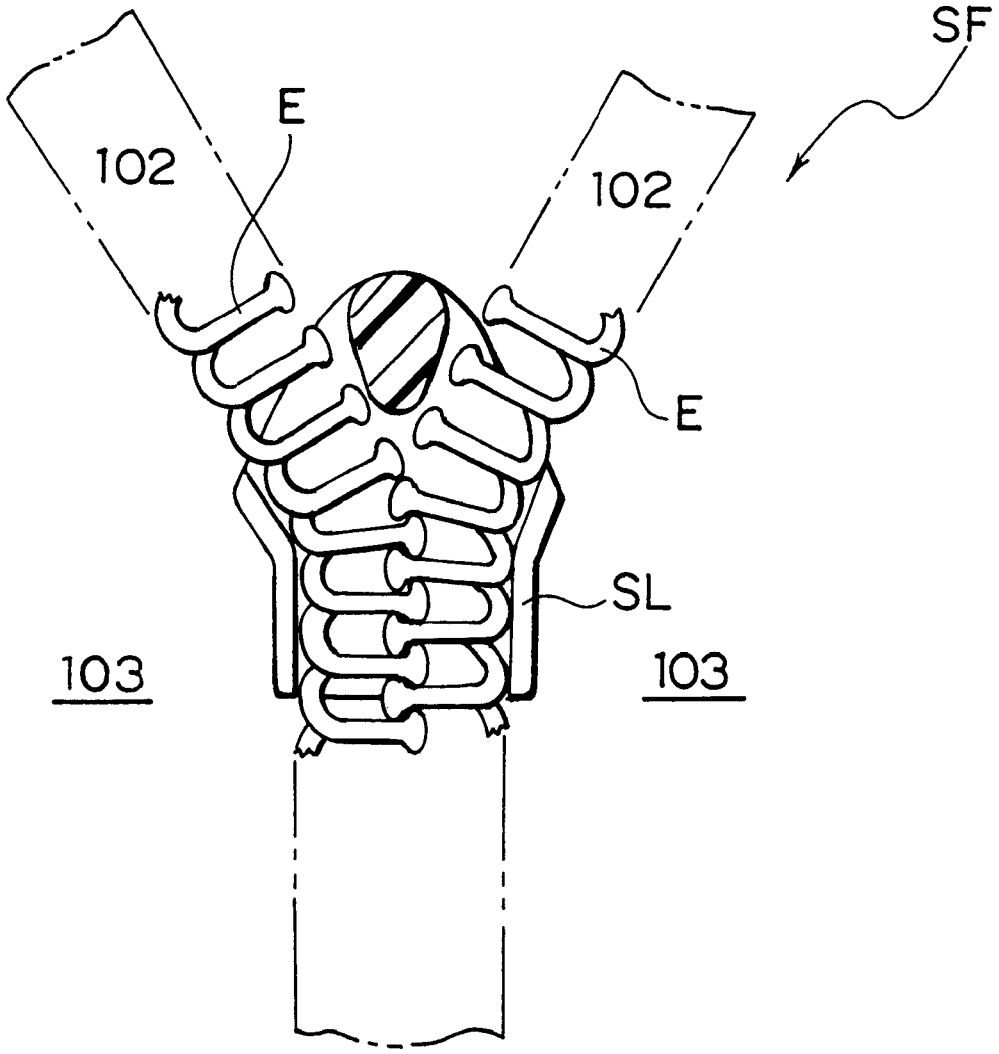
FIG. 3 is an explanatory view showing an opening/closing mechanism of a slide fastener.

As a result, fixing of the coupling element row ER onto the fastener tape 101 by the fixing warp yarns 3 to 8, and 10 to 15 is intensified particularly on the side of the connecting portions RC of the upper/lower leg portions L. Therefore, the coupling element portions E woven in parallel are arranged and fixed in order by an equal pitch along the coupling-element-row-fixing region 102 of the fastener tape 101. Thus, an opening/closing operation for a slide fastener SF by means of a slider SL, which slides along outer surfaces of the connecting portions RC of the coupling element portions E as shown in FIG. 3, can be smoothed extremely. Further, a gap between each pair of adjacent coupling heads EH can be expanded or reduced slightly. Thus, when the fastener is closed by the slider SL as shown in FIG. 3, the gaps between the adjacent coupling heads EH are expanded to an appropriate extent that the coupling operation of the coupling element portions E can be carried out smoothly.

Further, according to the above described embodiment, the patterns of the respective four adjacent element fixing warp yarns 3 to 6, which are disposed at the side of the coupling heads EH, are shifted by one pitch of the coupling element portion E in the longitudinal direction of the fastener tape 101. Consequently, each pair of the upper and lower leg portions L of each coupling element portion E is tightened at the right and left portions thereof by the adjacent fixing warp yarns 3 to 6 alternately, whose pattern is shifted in the longitudinal direction of the tape. Thus, the coupling head EH becomes slightly easier to move in its parallel direction while an extremely stabilized pitch is secured between the coupling heads EH.

Figure 4:
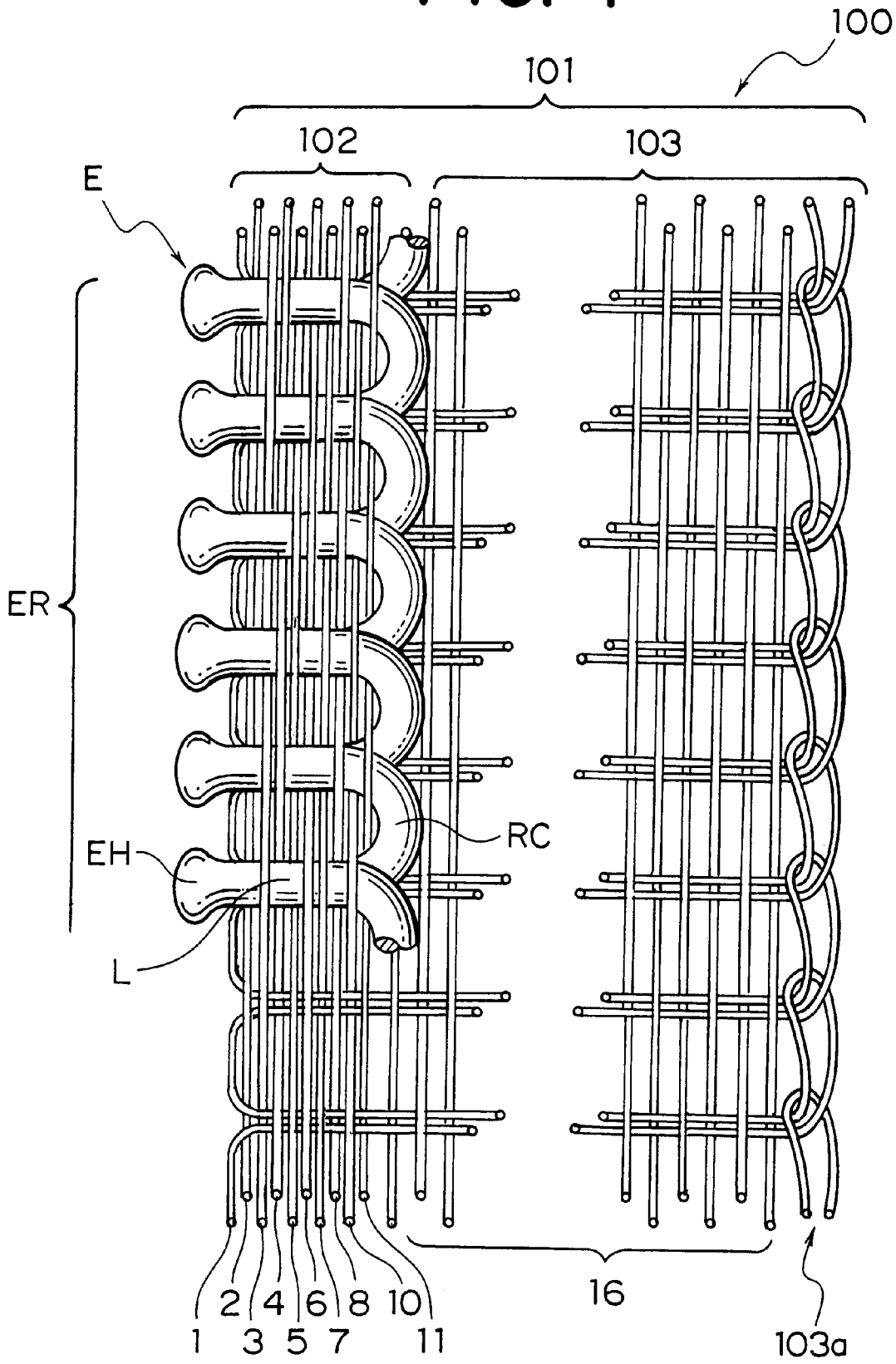
FIG. 4 is a plan view showing part of a slide fastener stringer according to a modified example of the first embodiment of the present invention, which is partly cut out.

FIG. 4 shows a modified example of the above-described embodiment. It is different from the above described embodiment in that the length of each pair of the upper and lower leg portions L of the coupling element portion E is shorter. Consequently, a tightening force of the coupling element portions E on the side of the connecting portions RC, which are woven and fixed in the coupling-element-row-fixing region 102, can be reduced as compared to the above described embodiment. Thus, the quantity of the fixing warp yarns, which are four yarns 7, 8, 10 and 11, disposed on the side of the connecting portions RC is less than the above described embodiment. Meanwhile, the weaving structure with the fixing warp yarns 3 to 6 on the side of the coupling heads EH and the weaving structure with the fixing warp yarns 7, 8, 10 and 11 on the side of the connecting portions RC are the same as the above described embodiment.

These weaving structures may be modified appropriately as far as the above-described structure of the present invention is applied.

Figure 5:
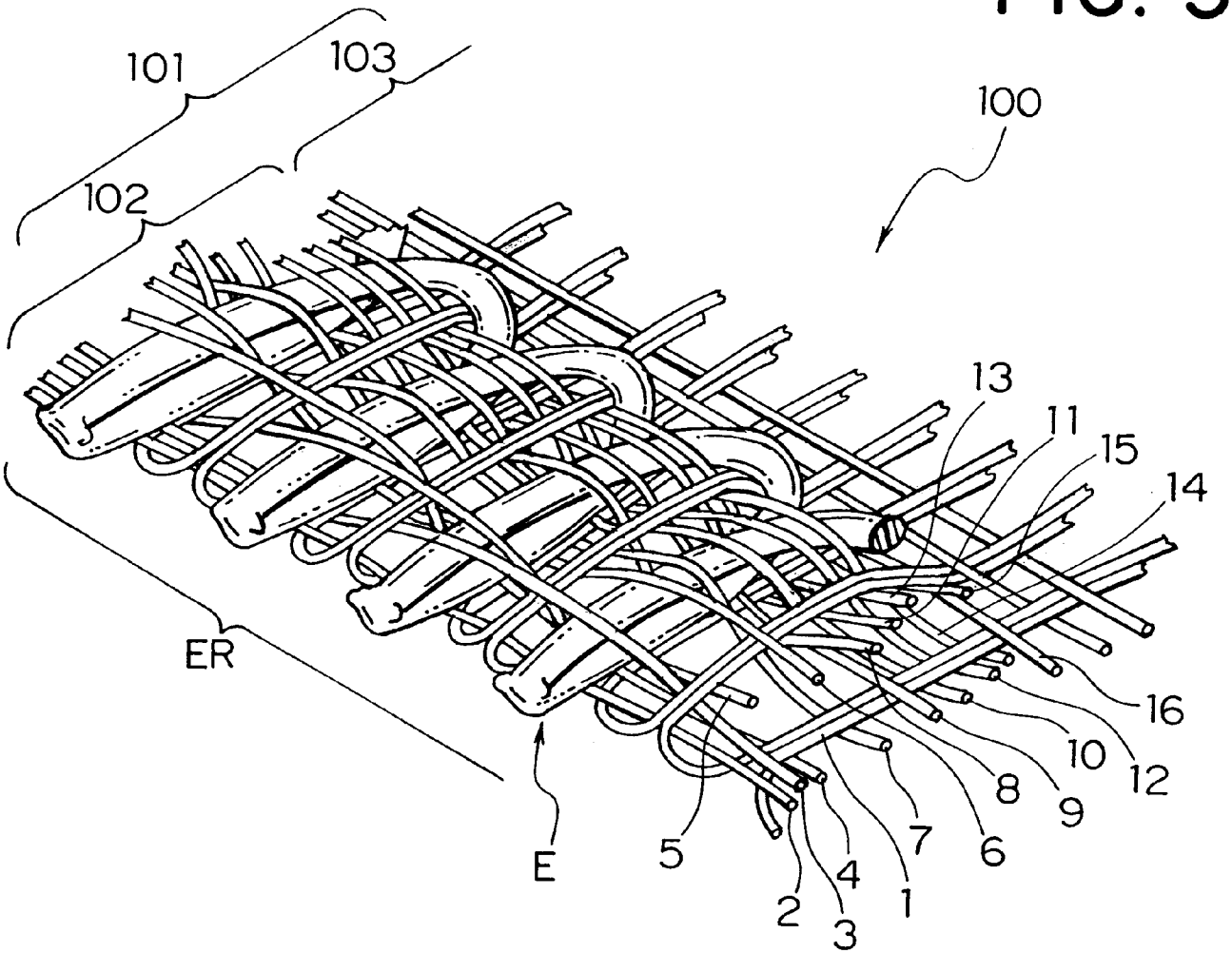
FIG. 5 is a partial perspective view showing part of a slide fastener stringer according to a second embodiment of the present invention, which is partly cut out.
Figure 6:
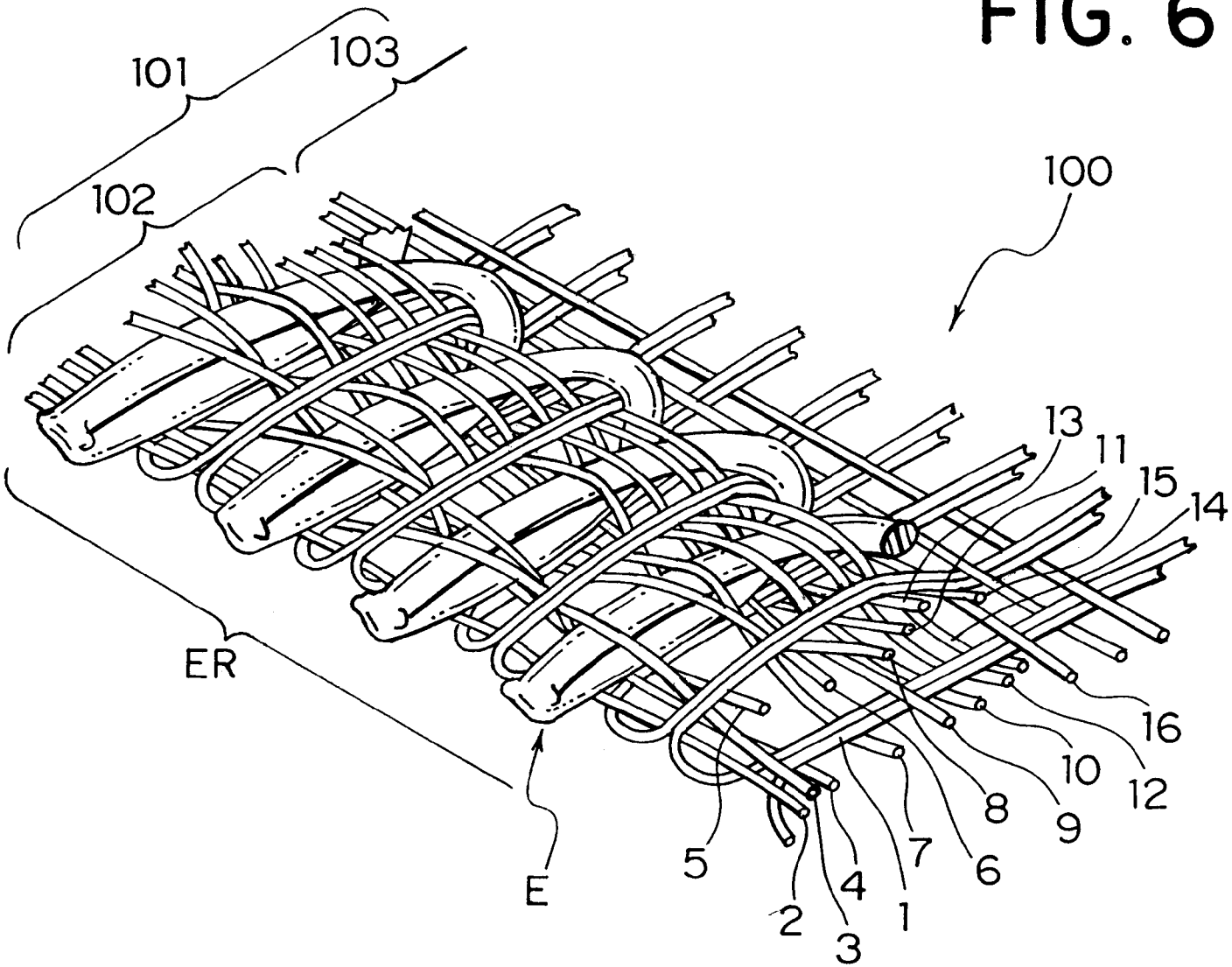
FIG. 6 is a partial perspective view showing part of a slide fastener stringer according to a third embodiment of the present invention, which is partly cut out.

FIGS. 5 and 6 are partial perspective views of attaching portions of coupling element rows of woven slide fastener stringers 100, according to the second and third embodiments of the present invention, in which the tape is woven by 2 picks/1 pitch. For easier understanding, various kinds of the weft yarns and warp yarns are shown relatively thin with respect to the coupling element row, and the weaving structure is shown coarsely. However, in the actual use, yarns having a predetermined thickness are used for the various weft yarns and warp yarns, in consideration of a function of the slide fastener stringer, and the weaving structure is formed more finely so as to provide a structure that can exert a function as a fastener. In these Figures, the same reference numerals are given to substantially the same components.

As understood from these Figures, in the woven slide fastener stringer 100 according to the second and third embodiments, each time when the foundation weft yarn 1 is weft inserted twice, the coupling element portion E is weft inserted. Consequently, the foundation weft yarn 1 is comprised of a portion disposed along the upper and lower leg portions L of each coupling element portion E and a portion disposed between the respective coupling element portions E.

According to these embodiments, the weaving structure with the fixing warp yarns 3 to 8, and 10 to 15 and the insertion warp yarn 9 with respect to each coupling element portion E are the same as the first embodiment. However, the foundation warp yarn 2 disposed at an outermost of the coupling-element-row-fixing region 102 and the foundation warp yarns 16, 16, . . . composing the fastener tape main portion 103 run over and run below all the foundation weft yarns 1 alternately.

The weaving structure of the foundation weft yarn 1 running between adjacent coupling element portions E in the coupling-element-row-fixing region 102 is quite different from the first embodiment. That is, with respect to the four fixing warp yarns 3 to 6 on the side of the coupling heads EH shown in FIG. 5, at every pitch, the foundation weft yarn 1 runs below the connecting portion RC of two coupling element portions E, then runs over three of the fixing warp yarns 3 to 6 and runs below the rest one of the respective warp yarns 3 to 6 that runs over the upper and lower leg portions L, successively.

According to an embodiment shown in FIG. 6, with respect to the four fixing warp yarns 3 to 6 disposed on the side of the coupling heads EH, at every pitch, the foundation weft yarn 1 runs below the connecting portion RC of two coupling element portions E and runs over the respective fixing warp yarns 3 to 6 and then entangles with the foundation warp yarn 2 disposed at the outermost of the coupling-element-row-fixing region 102, and then turns over. This is different from the first and second embodiments.

The second and third embodiments having such structures exert the same operation and effects as the first embodiment. Therefore, an initial object of the present invention can be achieved sufficiently.

Figure 7:
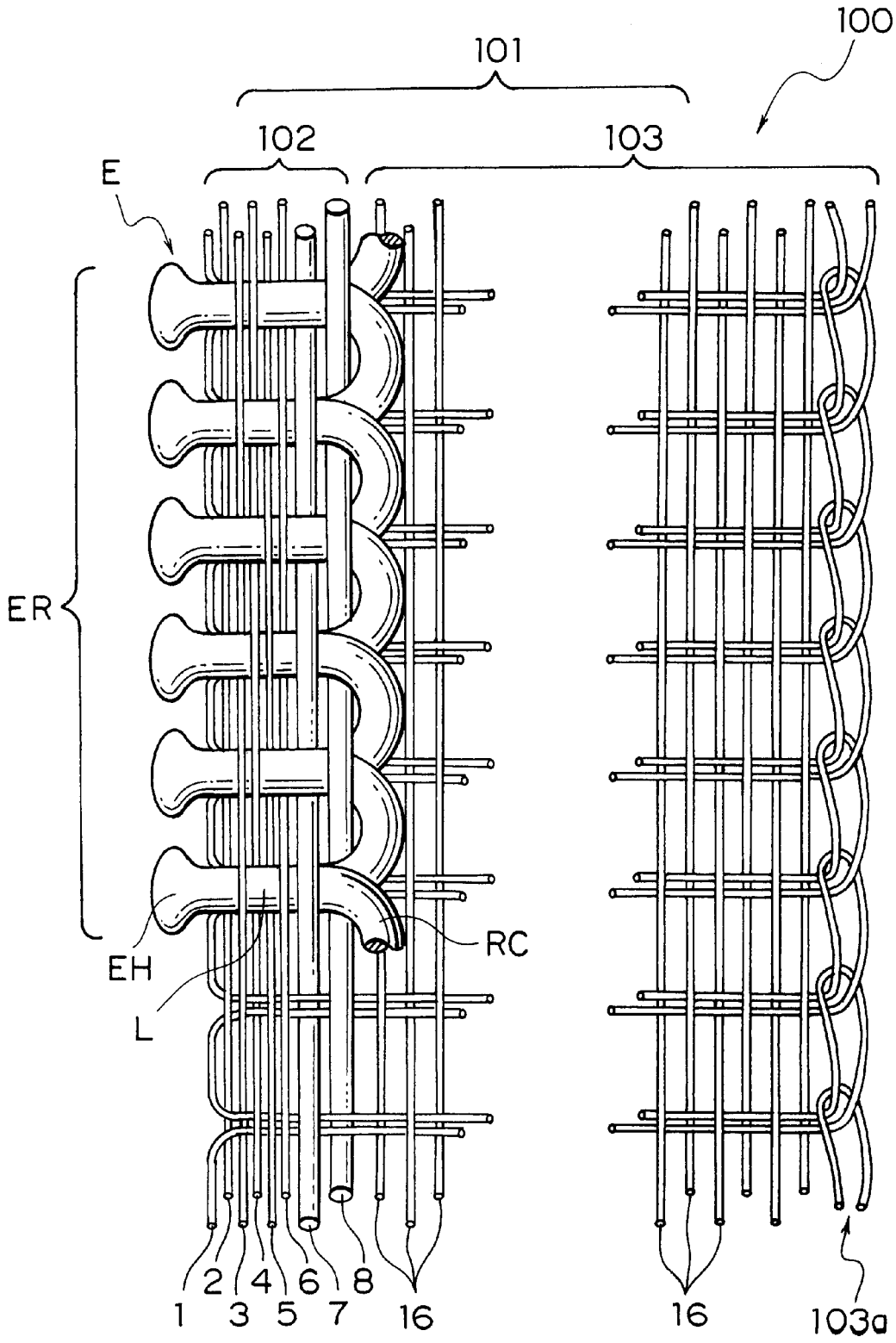
FIG. 7 is a plan view showing a slide fastener stringer according to a fourth embodiment of the present invention, which is partly cut out.
Figure 8:
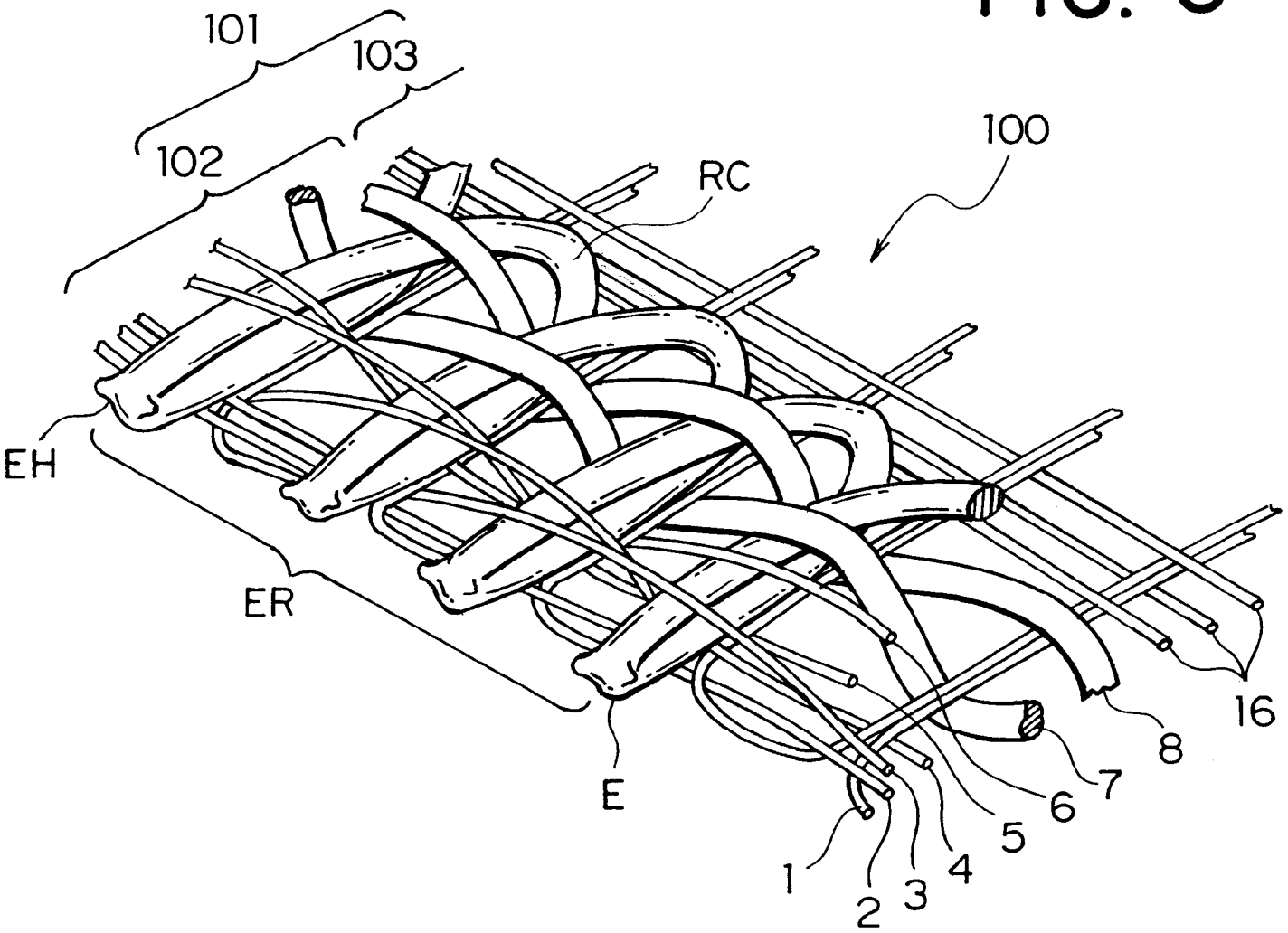
FIG. 8 is a partial perspective view showing a fixing structure of the coupling element rows of the slide fastener stringer.

FIGS. 7 and 8 respectively show a slide fastener stringer woven in a 1 pick/1 pitch, which is a fourth embodiment of the present invention. FIG. 7 is a plan view showing a fastener tape, a center portion in a width direction of which is omitted, and a coupling element row partly cut out. FIG. 8 is a partial perspective view of an attaching portion of the coupling element row of the stringer.

The woven slide fastener stringer 100 of this embodiment also includes a fastener tape 101, which is composed of a coupling-element-row-fixing region 102 and a tape main portion 103, and a coupling element row ER integrally woven into and fixed to the coupling-element-row-fixing region 102 of the fastener tape 101.

According to this embodiment, a foundation weft yarn 1, which is comprised of double yarns because it is weft inserted by reciprocation of a carrier bar (not shown) into a shuttle road in a warp yarn opening. The warp yarns are comprised of foundation warp yarns 16, 16, . . . composing a foundation structure of the fastener tape, and fixing warp yarns 3 to 8 for the coupling element row ER. The warp yarn 2 is disposed at an outermost of the fastener tape and function as a foundation warp yarn.

Six element-row-fixing warp yarns 3 to 8 are disposed in the coupling-element-row-fixing region 102 and a plurality of the foundation yarns 16, 16, . . . are disposed in the tape main portion 103. These warp yarns are successively arranged in the order of the numerals from an outside edge of the coupling-element-row-fixing region 102 and supplied onto a weaving machine (not shown). Although it is not shown, a plurality of foundation warp yarns, other than the fixing warp yarns 3 to 8, may be arranged in the coupling-element-row-fixing region 102 appropriately.

The coupling element row ER, which is comprised of a plurality of coupling element portions E formed continuously in a coil shape from a synthetic resin monofilament, is woven into and fixed into the weaving structure of the coupling-element-row-fixing region 102.

In this embodiment, the two warp yarns 7, 8 on the side of the connecting portions RC, among the fixing warp yarns 3 to 8, are thicker monofilaments than the other fixing warp yarns 3 to 6. The monofilaments can be of the same material as that of the coupling element row ER. However, a monofilament of a different material may be used according to an intended use of the slide fastener.

Besides the fixing warp yarns 7, 8 of thick monofilaments on the side of connecting portions RC, it is permissible to use multifilaments or monofilaments of a similar material as the thick monofilaments for the fixing warp yarns 3 to 6 on the side of the coupling heads EH. For example, it is possible to use general a spun yarn made of cotton yarns or semi synthetic fibers for example. In this embodiment, however, the pull elastic modulus of the fixing warp yarns 7, 8 of thick monofilaments disposed on the side of the connecting portions RC of the coupling element portions E is set to be lower than the pull elastic modulus of the fixing warp yarns 3 to 6 on the side of the coupling heads EH.

The two fixing warp yarns 7, 8 on the side of the connecting portions RC of the upper and lower leg portions L, which are adjacent to the four fixing warp yarns 3 to 6, run over the paired upper and lower leg portions L of a single coupling element portion E, and then run below the foundation weft yarn 1 disposed under a coupling element portion E of a next position, and repeats the same pattern. The repeating patterns of the respective fixing warp yarns are shifted by one pitch of the coupling element portion E in the longitudinal direction of the tape.

On the other hand, the adjacent four fixing warp yarns 3 to 6, which are disposed on the side of the coupling heads EH of the coupling element portions E, run over two adjacent pairs of the upper and lower leg portions L and then intersect the two foundation weft yarns 1 disposed below the pairs of the upper and leg portions L of a next position, and repeats the same pattern. The repeating patterns of the respective fixing warp yarns are shifted by one pitch of the coupling element portion E in the longitudinal direction of the tape. Thus, the coupling element portions E are successively woven and fixed in the fastener tape 101.

According to this embodiment, not only the fixing warp yarns 7, 8 on the side of connecting portions RC are thick monofilaments, but also the pull elastic modulus of these fixing warp yarns are set to be lower than the fixing warp yarns 3 to 6 on the side of the coupling heads EH as mentioned above. Consequently, after the coupling element row ER has been woven and fixed in the fastener tape, these adjacent thick monofilaments, which run between the adjacent foundation weft yarns 1 and the pairs of leg portions of the coupling element portions E, intersect therewith at a large intersecting angle, as compared to the other thinner fixing warp yarns 3 to 6. Therefore, the thick monofilaments can restrict the foundation weft yarns 1 and the coupling element portions E from being displaced in the pitch direction. Further, even if an external force is applied to the coupling element portions E, the fixing warp yarns 7, 8 on the side of the connecting portions RC are less stretchable in a fiber direction than those on the side of the coupling heads E, so that the coupling element portions E can be firmly fixed to the fastener tape in a stable fashion.

On the other hand, the fixing warp yarns 3 to 6 on the side of the coupling heads EH have smaller fineness and a higher pull elastic modulus than the monofilaments on the side of the connecting portions RC. Therefore, these fixing warp yarns, which run between the foundation weft yarns 1 and the pairs of leg portions of the coupling element portions E, intersect therewith at a small intersecting angle. Further, even if an external force is applied, these fixing warp yarns are displaced in the pitch direction to a larger extent, so that the respective gaps between the adjacent coupling heads EH can be expanded or reduced within measure, thereby smoothing the coupling and uncoupling of the coupling element portions. Thus, the pitch between the respective coupling element portions E becomes stable so that the slide fastener can retains its own function even after the opening and closing operation has been repeatedly done.

According to the present invention, however, the monofilaments for the fixing warp yarns 7, 8 on the side of the connecting portions RC are not always required to be thicker as well as have a higher pull elastic modulus than the fixing warp yarns 3 to 6. It is sufficient to have one of these characteristics, as far as the coupling element portions E can be fixed to the fastener tape as a required extent to achieve the above-mentioned objects of the present invention.

Foundation warp yarns 16 of the tape main portion 103, which are disposed at an inner side of the tape in parallel to each other, run over and below the parallel foundation weft yarns 1. Consequently, a plain weaving structure is formed. In this embodiment, At an outermost end side of the tape on the side of the coupling heads EH where the above-mentioned four fixing warp yarns 3 to 6 are disposed, a single foundation warp yarn 2 run over and below the foundation weft yarns 1, which turn over at the outermost end side of the tape, alternately.

Further, this embodiment employs a weaving structure that allows the tightening force by the fixing warp yarns 7, 8 on the side of the connecting portions RC of the pairs of the upper and lower leg portions L to be larger than that by the fixing warp yarns 3 to 6 on the side of the coupling heads EH, as described above. Therefore, the coupling element row ER can be more firmly fixed to the fastener tape 101, especially at the side of the connecting portions RC of the upper and lower leg portions L thereof, by the fixing warp yarns 3 to 8. Thus, the coupling element portions E, which are woven into the tape, can be fixed neatly along the coupling-element-row-fixing region 102 of the fastener tape 101 at an equal pitch in a stable fashion.

Therefore, similarly to the previously described embodiment, the opening and closing operation of a slide fastener S by a slider SL can be remarkably smoothed. Furthermore, the gaps between the respective adjacent coupling heads EH can be slightly expanded and reduced. As a result, the gaps between the respective adjacent coupling heads EH can be expanded within measure, so that the coupling of the respective coupling element portions can be smoothly performed.

Still further, according to this embodiment, it is possible to realize an improved stable fixing even with a less number of fixing warp yarns than the conventional ones that are of the same fineness and material. Consequently, it becomes possible to employ coupling element portions having shortened leg portions, so that the leg portions only need to have lengths to the minimum.

Figure 9:
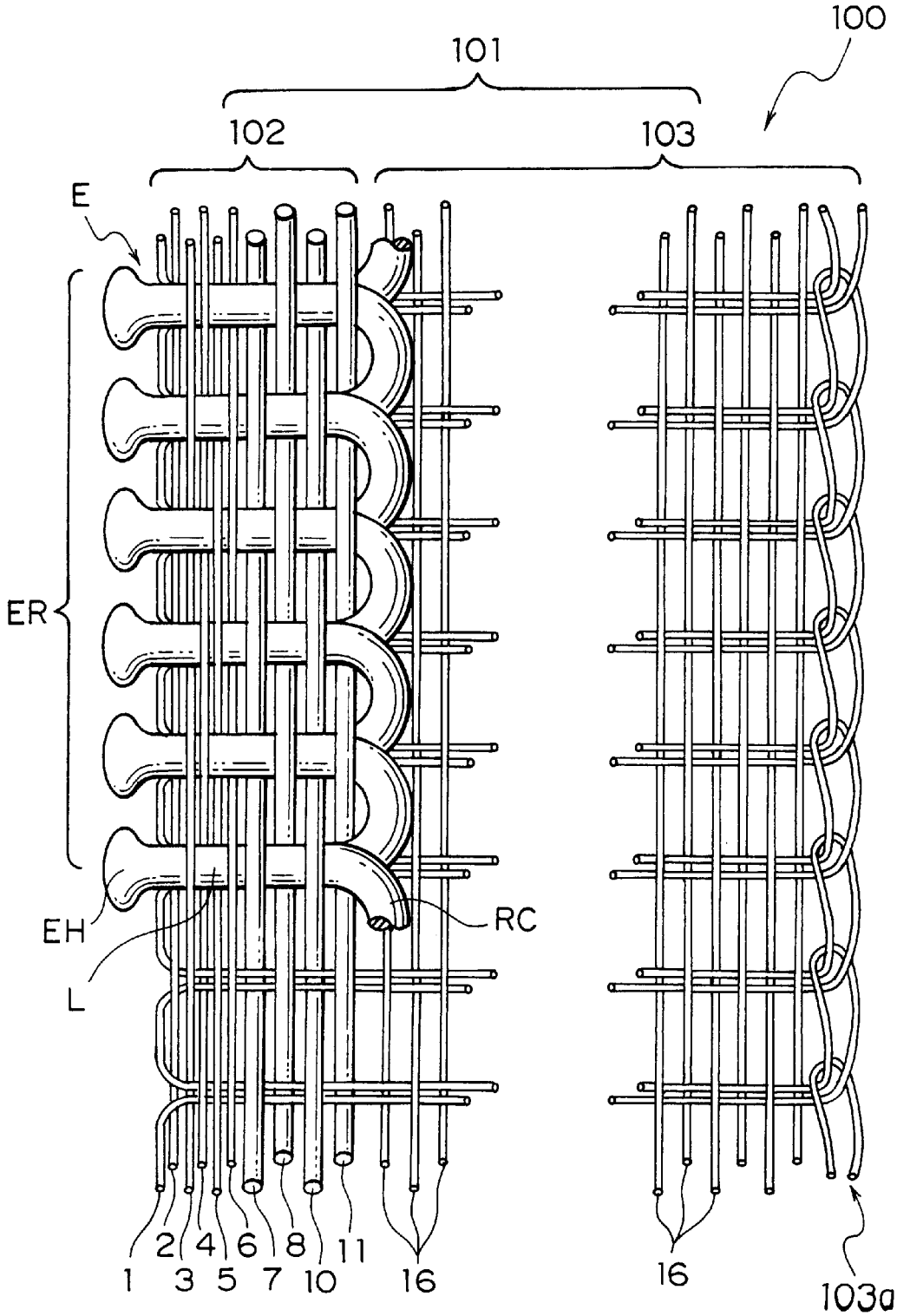
FIG. 9 is a plan view showing a slide fastener stringer according to a modified example of the fourth embodiment, which is partly cut out.

FIG. 9 shows a modified example of the above first embodiment. This modified example is the same as above in that four fixing warp yarns 3 to 6 are disposed on the side of the coupling heads EH of the coupling element portions E. However, it is different in those four fixing warp yarns of monofilaments, which were two in the first embodiment, are disposed on the side of the connecting portions RC because the leg portions E of the coupling element portions E are longer. In this weaving structure, two sets of fixing warp yarns, which are the same patterns as those of the above-described fixing warp yarns 7, 8, are disposed on the side of the connecting portions RC.

Figure 10:
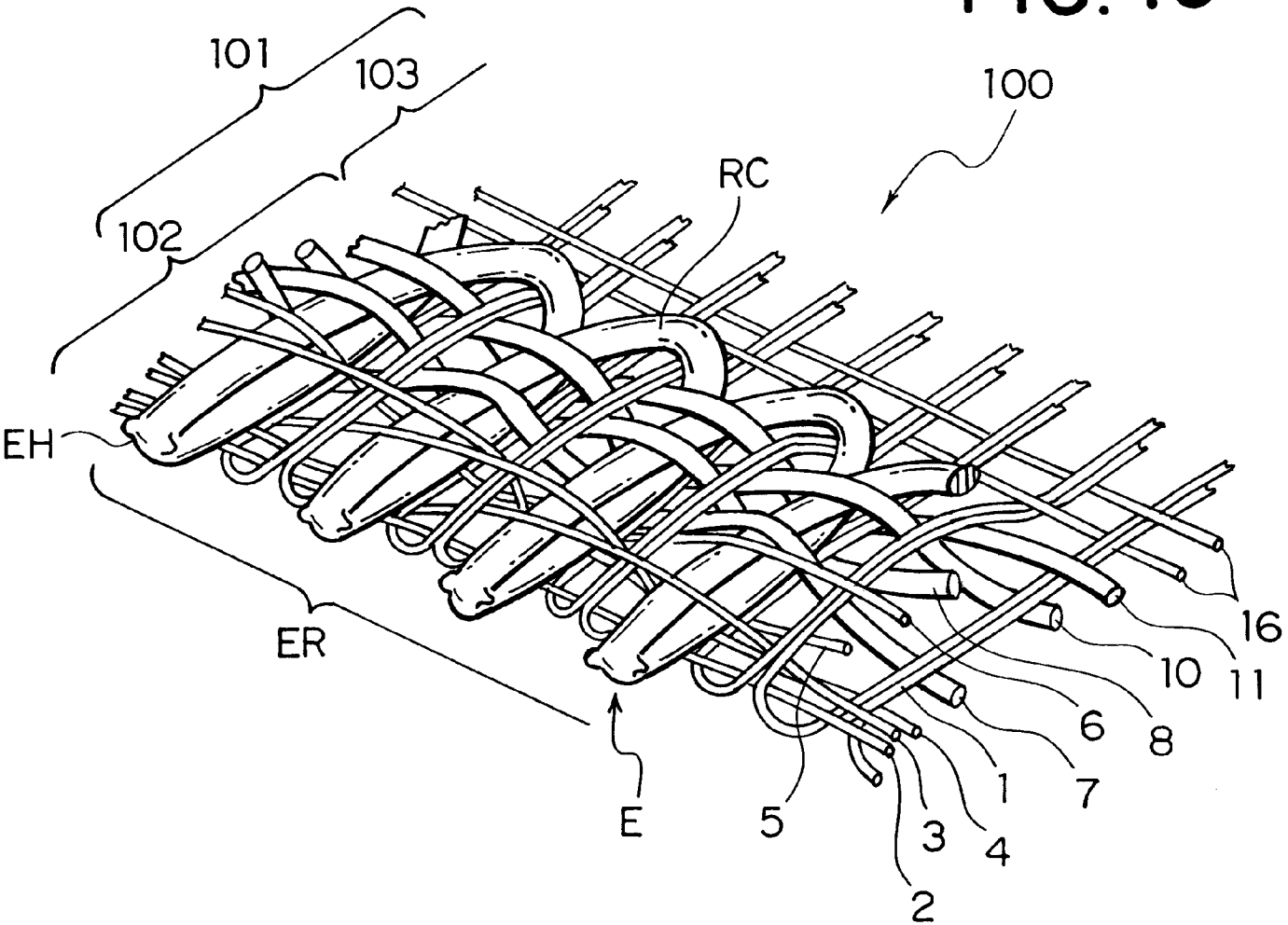
FIG. 10 is a partial perspective view showing part of a slide fastener stringer according to a fifth embodiment of the present invention, which is partly cut out.
Figure 11:
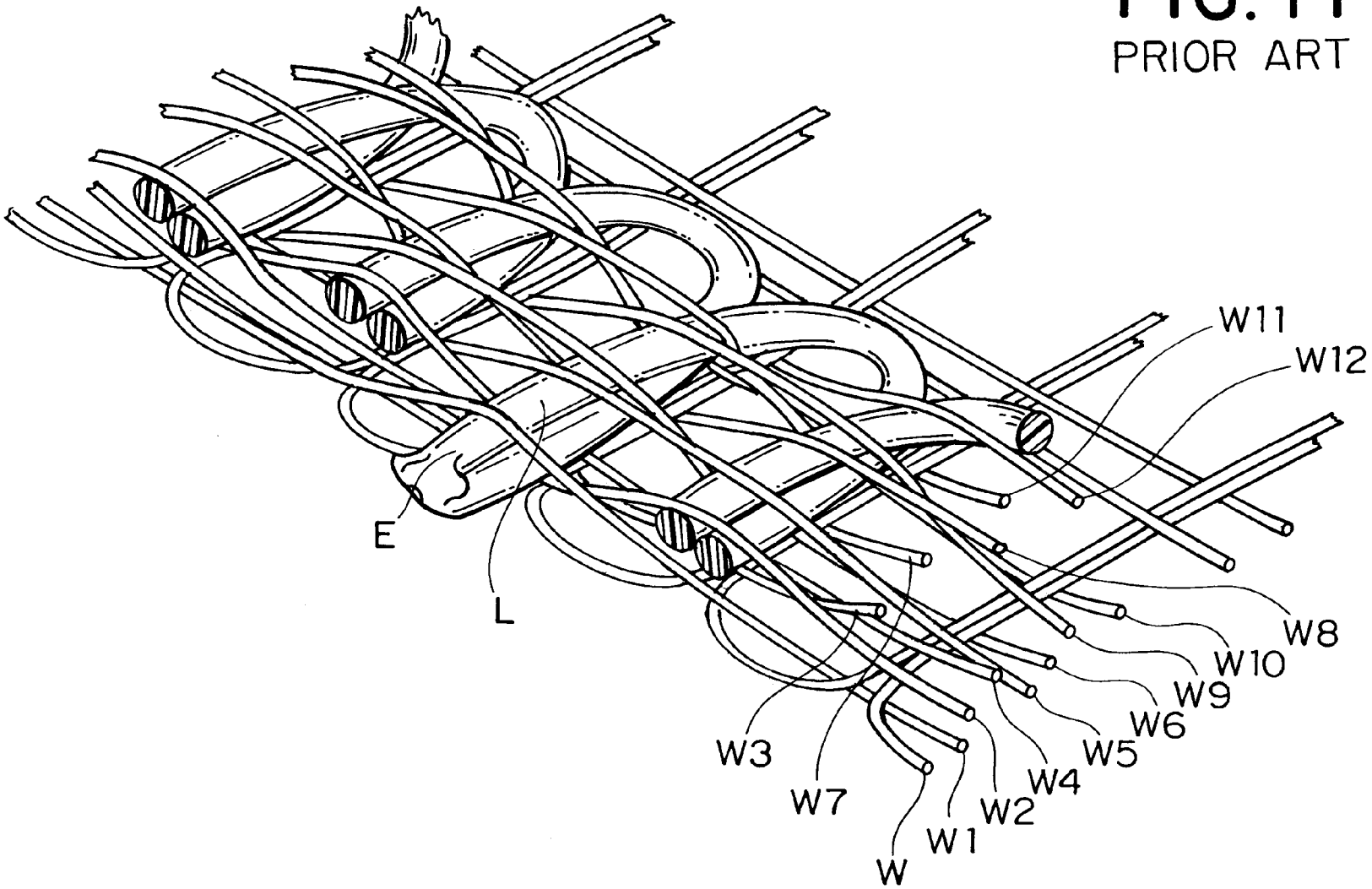
FIG. 11 PRIOR ART
FIG. 11 is a partial perspective view showing part of a conventional slide fastener stringer, which is partly cut out.

FIG. 10 is a partial perspective view of an attaching portion of a coupling element row of a woven slide fastener stringer 100, which is woven in two picks/1 pitch, according to a fifth embodiment of the present invention. For easier understanding of these Figures, various kinds of the weft yarns and warp yarns are shown relatively thin with respect to the coupling element row, and the weaving structure is shown coarsely. However, in the actual use, yarns having a predetermined thickness are used for the various weft yarns and warp yarns, in consideration of a function of the slide fastener stringer, and the weaving structure is formed more finely so as to provide a structure that can exert a function as a fastener. In these Figures, the same reference numerals are given to substantially the same components.

As being apparent from these Figures, in the woven slide fastener stringer 100 of this embodiment, the coupling element portions E are weft inserted each time two foundation weft yarns 1 are weft inserted. Consequently, some of the foundation weft yarns 1 are disposed along the paired upper and lower leg portions of the respective coupling element portions E while the others are disposed between the respective coupling element portions E.

In this embodiment, fixing warp yarns 7, 8, 10, 11, which are thick monofilaments, are woven into the connecting portions RC of the coupling element portions E, similarly to the above-described modified example. On the side of the coupling heads EH, four thin fixing warp yarns 3 to 6 are woven, similarly to the above-described first embodiment.

The weaving structure of the respective fixing warp yarns 3 to 8 with respect to the respective coupling element portions E is identical with that of the above-described first embodiment. On the other hand, the weaving structure of the foundation weft yarns 1, which run between the respective adjacent coupling element portions E, in the coupling-element-row-fixing region 102 is quite different from the above-described first embodiment. Specifically, with respect to the four fixing warp yarns 3 to 6 on the side of the coupling heads EH, at every pitch of the coupling element portion E, the foundation weft yarns 1 run below the connecting portion RC of two coupling element portions E, then runs over three of the fixing warp yarns 3 to 6 and runs below the rest one of the respective warp yarns 3 to 6 that runs over the upper and lower leg portions L, successively.

Furthermore, in this embodiment, the fixing warp yarns 7, 8, 10, 11, which are composed of four monofilaments and disposed on the side of the connecting portions RC, are not only thicker but also more rigid than the four fixing warp yarns 3 to 6 disposed on the side of the coupling heads EH. If the rigidity is thus enhanced, the fixing warp yarns 7, 8, 10, 11 disposed on the side of the connecting portions RC are less flexible than the four fixing warp yarns 3 to 6 disposed on the side of the coupling heads EH, so that they are somewhat difficult to weave in. However, after having been woven, the fixing warp yarns 7, 8, 10, 11 disposed on the side of the connecting portions RC have a larger tightening force against the coupling element portions E than the fixing warp yarns 3 to 6 disposed on the side of the coupling heads EH, and further, their crimping form is stabilized. Therefore, it is possible to obtain a required fixing force with respect to the fastener tape. On the side of the coupling heads EH, the gaps between the respective adjacent coupling heads EH can be expanded within measure, similarly to the above-described embodiments. Therefore, the respective coupling element portions E can be coupled and uncoupled smoothly.

The above-described embodiments relate to a typical woven slide fastener stringer and therefore the present invention should not be restricted to these embodiments. For example, it is permissible to employ not doubled foundation yarn but a single foundation yarn. Further, the quantity, the dispositions and the weaving structures of the fixing warp yarns may be modified freely within a scope of a gist of the present invention.

What is claimed:

1. A woven slide fastener stringer, comprising:

a fastener tape comprising a plurality of foundation weft yarns and a plurality of weft yarns;

a plurality of coupling element portions, which are continuously formed of synthetic resin monofilament, woven successively along a side edge of the fastener tape with a plurality of element fixing warp yarns arranged in parallel at the same time when said fastener tape is woven; and wherein each of said coupling element portions is comprised of a coupling head extending from the side edge of said fastener tape, a pair of parallel leg portions comprising an upper leg portion and a lower leg portion extend into the fastener tape from opposite ends of said coupling head and a connecting portion for connecting each end of the pair of the upper and lower leg portions with one of a lower or an upper leg portion of an adjacent coupling element portion, said woven fastener further comprising a weaving structure that a tightening force to the pair of the upper and lower leg portions by at least two of the plurality of the element fixing warp yarns arranged in parallel, which are disposed on a side of said coupling heads, is smaller than a tightening force to the pair of the upper and lower leg portions by at least one of the element fixing warp yarns disposed on a side of said connecting portions whereby the plurality of the element fixing yarns arranged in parallel are woven into said coupling element portions and the foundation weft yarns.

2. A woven slide fastener stringer according to claim 1, wherein said at least one of the plurality of the element fixing warp yarns arranged in parallel, which is disposed on the side of the connecting portions, is composed of a monofilament that has a larger tightening force to the pair of the upper and lower leg portions than the tightening force by any other one of the element fixing warp yarns.

3. A woven slide fastener stringer according to claim 1, wherein said at least two element fixing warp yarns disposed on the side of the coupling heads, which have a small tightening force to the pair of the upper and lower leg portions, intersect two or more of the foundation weft yarns running below each of the lower leg portions and then run over top faces of adjacent two or more upper leg portions of the upper and lower leg portions disposed at the side of the coupling heads (EH), and repeat the same pattern successively, and the element fixing warp yarns disposed on the side of the connecting portions, which have a large tightening force to the pair of the upper and lower leg portions, run below one of the foundation weft yarns and then run over a top face of the upper leg portion of the pair of the upper and lower leg portions at the side of the connecting portions, and repeat the same pattern successively.

4. A woven slide fastener stringer according to claim 1, wherein the patterns of said at least two adjacent element fixing warp yarns disposed on the side of the coupling heads are shifted by one pitch of each of the coupling element portions in a longitudinal direction of the fastener tape.

5. A woven slide fastener stringer according to claim 1, wherein each of the coupling element portions is weft inserted together with the foundation weft yarn.

6. A woven slide fastener stringer according to claim 1, wherein each of the coupling element portions is weft inserted with respect to every other foundation weft yarn.

7. A woven slide fastener stringer according to claim 1, wherein at least one of the plurality of warp yarns is disposed between the coupling heads and the element fixing warp yarn disposed at the nearest to the coupling heads, and said at least one of plurality of warp yarns alternately runs over and below the weft yarns that are weft inserted and arranged adjacent to each other.

8. A woven slide fastener stringer according to claim 1, wherein said at least one of the plurality of the element fixing warp yarns disposed on the side of said connecting portions is thicker than any other one of the element fixing warp yarns disposed on the side of said coupling heads.

9. A woven slide fastener stringer according to claim 1, wherein said at least one of the plurality of the element fixing warp yarns disposed on the side of said connecting portions has a lower pull elastic modulus than any other one of the element fixing warp yarns disposed on the side of said coupling heads.

10. A woven slide fastener stringer according to claim 1, wherein said at least one of the plurality of the element fixing warp yarns disposed on the side of said connecting portions has a larger rigidity than any other one of the element fixing warp yarns disposed on the side of said coupling heads.

* * * * *